US005188085A

United States Patent [19]

Habaguchi et al.

[11] Patent Number: 5,188,085

[45] Date of Patent: Feb. 23, 1993

[54] DEVICE FOR MEASURING CONCENTRATION/FLOW RATE OF A MIXTURE DRAWN INTO AN INTERNAL COMBUSTION ENGINE AND AIR-FUEL RATIO CONTROL SYSTEM OF THE ENGINE INCORPORATING THE DEVICE

[75] Inventors: Masayuki Habaguchi; Toyohei Nakajima; Fumio Hosoda; Sachito Fujimoto; Masakazu Kitamoto; Hideo Moriwaki; Takefumi Nakamura, all of Wako, Japan

[73] Assignee: Honda Giken Kogyo Kabushiki Kaisha, Tokyo, Japan

[21] Appl. No.: 853,289

[22] Filed: Mar. 18, 1992

[30] Foreign Application Priority Data

Mar. 19, 1991 [JP] Japan ..... 3-80726

[51] Int. Cl.[5] ..... F02M 25/08; F02D 41/04

[52] U.S. Cl. ..... 123/520

[58] Field of Search ..... 123/518, 519, 520, 698

[56] References Cited

U.S. PATENT DOCUMENTS 4,949,695 8/1990 Uranishi et al. ..... 123/520

5,111,796 5/1992 Ogita ..... 123/520

FOREIGN PATENT DOCUMENTS 62-131962 6/1987 Japan .

63-111277 5/1988 Japan .

*Primary Examiner*—Tony M. Argenbright

*Attorney, Agent, or Firm*—Nikaido, Marmelstein, Murray & Oram

[57] ABSTRACT

A device for measuring a flow rate of a mixture of evaporative fuel and air supplied to an internal combustion engine comprises a plurality of flowmeters arranged in a purging passage connecting between a canister and an intake passage of the engine for purging the mixture of evaporative fuel and air therethrough into the intake passage. The flowmeters have different output characteristics relative to concentration of the evaporative fuel in the mixture. At least one of the concentration of the evaporative fuel in the mixture and the volumetric flow rate of the mixture are detected based on outputs from the flowmeters. In an air-fuel ratio control system incorporating the above device, the weight per unit time of evaporative fuel supplied to the intake system is calculated from the detected concentration of the evaporative fuel and the detected volumetric flow rate of the mixture. The air-fuel ratio of a total air-fuel mixture supplied to the engine is corrected by the use of the ratio of the calculated weight per unit time of evaporative fuel supplied by purging to the intake system to weight per unit time of fuel supplied by injection to the engine.

10 Claims, 6 Drawing Sheets

DEVICE FOR MEASURING CONCENTRATION/FLOW RATE OF A MIXTURE DRAWN INTO AN INTERNAL COMBUSTION ENGINE AND AIR-FUEL RATIO CONTROL SYSTEM OF THE ENGINE INCORPORATING THE DEVICE

BACKGROUND OF THE INVENTION b 1. Field of the Invention

This invention relates to a device for measuring the concentration and/or flow rate of a mixture supplied from a purging passage of an evaporative emission control system of an internal combustion engine to the intake system of the engine, and a system for controlling the air-fuel ratio of a mixture supplied to the engine by the use of the measured concentration and/or flow rate of the former mixture.

2. Prior Art

Conventionally, evaporative emission control systems have widely been used in internal combustion engines, which operate to prevent evaporative fuel (fuel vapor) from being emitted from a fuel tank into the atmosphere, by temporarily storing evaporative fuel from the fuel tank in a canister, and purging same into the intake system of the engine. Purging of evaporative fuel into the intake system causes instantaneous enriching of an air-fuel mixture supplied to the engine. If the purged evaporative fuel amount is small, the air-fuel ration of the mixture will then be promptly returned to a desired value, with almost no fluctuation.

However, if the purged evaporative fuel amount is large, the air-fuel ratio of the mixture fluctuates. For example, a large amount of fuel vapor can be produced in the fuel tank immediately after refueling or fill-up. In order to prevent fluctuations in the air-fuel ratio due to purging of evaporative fuel (fuel vapor) on such an occasion, there has been proposed e.g. by Japanese Provisional Patent Publication (Kokai) No. 63-111277 a purging gas flow rate control system which reduces the purging amount of a mixture of evaporative fuel and air from the start of the engine immediately after refueling or fill-up until the speed of the vehicle in which the engine is installed reaches a predetermined value, and also reduces the purging amount of the mixture after the vehicle speed has reached the predetermined value and until the accumulated time period over which the vehicle speed exceeds the predetermined value reaches a predetermined value.

Further, an air-fuel ratio control system is also known, which first effects purging of evaporative fuel in such a small amount as to cause almost no fluctuation of the air-fuel ratio, then detects an amount of variation of an air-fuel ratio correction coefficient applied to feedback control of the air-fuel ratio, which is caused by the purging, forecast from the detected variation amount a value of the air-fuel ratio correction coefficient which should be assumed when the purged evaporative fuel amount is large, and thereafter applies the forecast value as the air-fuel ratio correction coefficient in the feedback control when the actual purged evaporative fuel amount becomes large, so as to reduce the fuel amount supplied to the engine, whereby fluctuations in the air-fuel ratio can be suppressed even when the purged amount is large (e.g. Japanese Provisional Patent Publication (Kokai) No. 62-131962).

However, the former conventional system is liable to fail to perform accurate control of the air-fuel ratio since the actual purged amount (the actual purged amount of the mixture of evaporative fuel and air) is not detected in controlling the flow rate of the purged mixture. More specifically, an amount of evaporative fuel produced by refueling and hence the resulting concentration of evaporative fuel in the mixture supplied from the purging passage into the intake system after refueling depend on an amount of fuel remaining in the fuel tank just before refueling, so that the amount of purged evaporative fuel after refueling varies. According to this conventional system, therefore, if the purging amount of the mixture is set to a relatively large value in expectation of the concentration of evaporative fuel in the mixture after refueling being relatively small, fluctuations can inevitably occur in the air-fuel ratio when a mixture with a high concentration of evaporative fuel is supplied by purging into the intake system. On the contrary, if the purging amount is set to a relatively small value in expectation of the concentration of evaporative fuel in the mixture after refueling being relatively high, the occurrence of fluctuations in the air-fuel ratio can be avoided, but the evaporative emission control cannot be performed to an adequate extent, if a mixture with a low concentration of evaporative fuel is then supplied by purging into the intake system.

Further, in the latter conventional system, the actual purged amount is not directly detected for the control of the air-fuel ratio, but the actual purged amount is estimated from the variation in the air-fuel ratio correction coefficient caused by the small purging amount, and at the same time, a variation amount in the air-fuel ratio to be caused by a large purging amount is forecast from the variation amount in the air-fuel ratio caused by the small purging amount. Therefore, the variation in the coefficient cannot be forecast accurately, which prevents accurate control of the air-fuel ratio from being carried out when purging of the evaporative fuel is effected.

Thus, both of the conventional systems can undergo fluctuations in the air-fuel ratio, resulting in degraded exhaust emission characteristics and fluctuations in engine output torque.

SUMMARY OF THE INVENTION

It is an object of the invention to provide a device which is capable of accurately measuring the concentration of evaporative fuel evaporated in the fuel tank and supplied to the intake system of the engine and/or the volumetric flow rate of a mixture containing the evaporative fuel (evaporative mixture).

It is another object of the invention to provide an air-fuel ratio control system which is capable of accurately controlling the air-fuel ratio of a mixture supplied to the engine by the use of the measured concentration and volumetric flow rate of the evaporative mixture.

To attain the first-mentioned object, according to a first aspect of the present invention, there is provided a device for measuring a flow rate of a mixture of evaporative fuel and air supplied to an internal combustion engine, the engine having an intake passage, a fuel tank, a canister for adsorbing evaporative fuel generated from the fuel tank, and a purging passage connecting between the canister and the intake passage for purging the mixture of evaporative fuel and air therethrough into the intake passage.

The device according to the first aspect of the invention is characterized by comprising:

a plurality of flowmeters arranged in the purging passage, the flowmeters having different output characteristics relative to concentration of the evaporative fuel in the mixture; and detecting means for detecting at least one of the concentration of the evaporative fuel in the mixture and a volumetric flow rate of the mixture, based on outputs from the flowmeters.

Preferably, the detecting means detects at least one of the concentration of the evaporative fuel in the mixture and the volumetric flow rate of the mixture, by the use of a ratio between the outputs from the flowmeters.

In one form of the invention, the flowmeters are arranged in the purging passage in series with each other.

Alternatively, the flowmeters are arranged in the purging passage in parallel with each other.

Specifically, the purging passage has a portion formed of a plurality of conduits extending parallel with each other, the flowmeters being arranged, respectively, in the conduits.

For example, the flowmeters comprise a differential pressure type flowmeter and a mass flowmeter.

To attain the second-mentioned object, according to a second aspect of the invention, there is provided an air-fuel ratio control system for an internal combustion engine having an intake passage, a fuel tank, a canister for adsorbing evaporative fuel generated from the fuel tank, and a purging passage connecting between the canister and the intake passage for purging a mixture of evaporative fuel and air therethrough into the intake passage.

The air-fuel ratio control system according to the second aspect of the invention is characterized by comprising:

a plurality of flowmeters arranged in the purging passage, the flowmeters having different output characteristics relative to concentration of the evaporative fuel in the mixture;

detecting means for detecting the concentration of the evaporative fuel in the mixture and a volumetric flow rate of the mixture, based on outputs from the flowmeters;

evaporative fuel weight-calculating means for calculating weight per unit time of evaporative fuel supplied to the intake passage from the detected concentration of the evaporative fuel and the detected volumetric flow rate of the mixture; and correcting means for correcting the air-fuel ratio of a total air-fuel mixture supplied to the engine by the use of a ratio of the calculated weight per unit time of evaporative fuel supplied by purging to the intake passage to weight per unit time of fuel supplied by injection to the engine.

Specifically, the correcting means corrects the air-fuel ratio of the total mixture supplied to the engine by correcting a basic fuel injection amount determined depending on a plurality of engine operating parameters in a manner such that the amount of fuel injected into the engine becomes smaller, as the ratio is larger.

For example, the correcting means corrects the air-fuel ratio of the total mixture supplied to the engine by multiplying the basic fuel injection amount by a correction coefficient determined by the ratio.

Preferably, the air-fuel ratio control system further includes:

control valve means arranged across the purging passage for controlling the flow rate of the mixture of evaporative fuel and air supplied to the intake passage;

desired evaporative fuel flow rate-calculating means for calculating a desired flow rate of purged evaporative fuel from a flow rate of intake air supplied to the engine;

actual evaporative fuel flow rate-calculating means for calculating an actual flow rate of purged evaporative fuel from the detected concentration of the evaporative fuel and the detected volumetric flow rate of the mixture; and control valve-controlling means for comparing between the desired flow rate of the purged evaporative fuel and the actual flow rate of same, and correcting based on results of the comparison, the opening of the control valve.

The above and other objects, features, and advantages of the invention will be more apparent from the ensuring detailed description taken in conjunction with the accompanying drawings.

DETAILED DESCRIPTION

The invention will now be described in detail with reference to the drawings showing an embodiment thereof.

Figure 1:
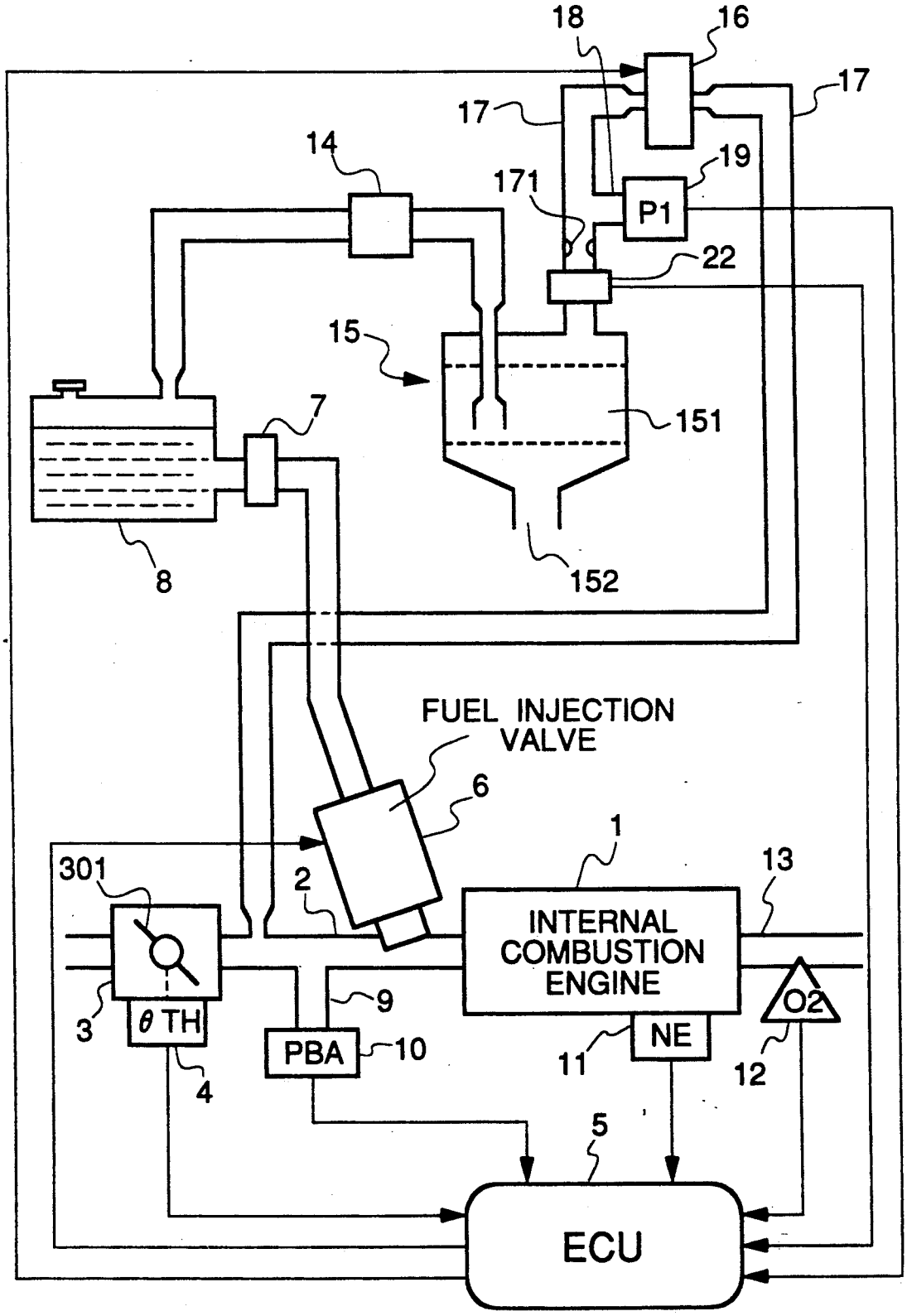
FIG. 1 is a block diagram showing the whole arrangement of a fuel supply control system according to an embodiment of the invention.

Referring first to FIG. 1, there is illustrated the whole arrangement of a fuel supply control system of an internal combustion engine, including an evaporative fuel-purging control system according to an embodiment of the invention. In the figure, reference numeral 1 designates an internal combustion engine which is installed in an automotive vehicle, not shown. The engine is a four-cylinder type, for instance. Connected to the cylinder block of the engine 1 is an intake pipe 2 across which is arranged a throttle body 3 accommodating a throttle valve 301 therein. A throttle valve opening ($\theta$TH) sensor 4 is connected to the throttle valve 301 for generating an electric signal indicative of the sensed throttle valve opening and supplying same to an electronic control unit (hereinafter called "the ECU") 5. The ECU 5 forms detecting means, evaporative fuel weight-calculating means, and correcting means.

Fuel injection valves 6, only one of which is shown, are inserted into the interior of the intake pipe 2 at locations intermediate between the cylinder block of the engine 1 and the throttle valve 301 and slightly upstream of respective intake valves, not shown. The fuel injection valves 6 are connected to a fuel tank 8 via a fuel pump 7, and electrically connected to the ECU 5 to have their valve opening periods controlled by signals therefrom.

On the other hand, an intake pipe absolute pressure (PBA) sensor 10 is provided in communication with the interior of the intake pipe 2 via a conduit 9 at a location immediately downstream of the throttle valve 301 for supplying an electric signal indicative of the sensed absolute pressure within the intake pipe 2 to the ECU 5.

An engine rotational speed (NE) sensor 11 is arranged in facing relation to a camshaft or a crankshaft of the engine 1, not shown. The engine rotational speed sensor 11 generates a pulse as a TDC signal pulse at each of predetermined crank angles whenever the crankshaft rotates through 180 degrees, the pulse being supplied to the ECU 5.

An $O_2$ sensor 12 as an exhaust gas ingredient concentration sensor is mounted in an exhaust pipe 13 connected to the cylinder block of the engine 1, for sensing the concentration of oxygen present in exhaust gases emitted from the engine 1 and supplying an electric signal indicative of the sensed oxygen concentration to the ECU 5.

A conduit line (purging passage) 17 extends from an upper space in the fuel tank 8 which has an enclosed body, and opens into the intake pipe 2 at a location downstream of the throttle body 3. Arranged across the conduit line 17 is an evaporative emission control system (part of the evaporative fuel-purging control system) comprising a two-way valve 14, a canister 15 having an adsorbent 151, and a purge control valve 16 in the form of a linear control valve which has a solenoid, not shown, for driving a valve element thereof, not shown. The solenoid of the purge control valve 16 is connected to the ECU 5 and controlled by a signal supplied therefrom to change the valve opening (EACV) linearly. According to this evaporative emission control system, evaporative fuel or fuel vapor (hereinafter merely referred to as "evaporative fuel") generated within the fuel tank 8 forcibly opens a positive pressure valve, not shown, of the two-way valve 14 when the pressure of the evaporative fuel reaches a predetermined level, to flow through the valve 14 into the canister 15, where the evaporative fuel is adsorbed by the adsorbent 151 in the canister and thus stored therein. The purge control valve 16 is closed when its solenoid is not energized by the control signal from the ECU 5, whereas it is opened when the solenoid is energized, whereby negative pressure in the intake pipe 2 causes evaporative fuel temporarily stored in the canister 15 to flow therefrom together with fresh air introduced through an outside air-introducing port 152 of the canister 15 at the flow rate determined by the valve opening of the purge control valve 16 corresponding to the current amount of the signal applied thereto, through the purging passage 17 into the intake pipe 2 to be supplied to the cylinders. When the fuel tank 8 is cooled due to low ambient temperature, etc. so that negative pressure increases within the fuel tank 8, a negative pressure valve, not shown, of the two-way valve 14 is opened to return part of the evaporative fuel stored in the canister 15 into the fuel tank 8. In the above described manner, the evavporative fuel generated within the fuel tank 8 is prevented from being emitted into the atmosphere.

A restriction 171 is formed in a portion of the purging passage 17 at a location between the canister 15 and the purge control valve 16. Further, a pressure gauge 19 is connected via a conduit 18 to the purging passage 17 at a location between the restriction 171 and the purge control valve 16. The pressure gauge 19 and the restriction 171 cooperate to form a differential pressure type flowmeter. The pressure gauge 19 is formed by an atmospheric pressurebased differential pressure gauge which detects relative pressure PI within the purging passage 17 to atmospheric pressure and supplies a signal indicative of the sensed relative pressure PI to the ECU 5. The differential pressure type flowmeter is also formed by the ECU 5 which calculates a flow rate Q1 of a mixture of evaporative fuel and air passing through the restriction 171, based on the area of the restriction 171 and a value of the relative pressure PI detected by the pressure gauge 19.

Further, a mass flowmeter 22, which is formed e.g. by a hot wire type flowmeter is arranged across the purging passage 17 at a location between the canister 15 and the restriction 171, which detects a flow rate of the mixture of evaporative fuel and air flowing in the purging passage 17 and supplies a signal indicative of the detected flow rate to the ECU 5. The hot wire type flowmeter 22 is formed of a platinum wire and utilizes the nature of the platinum wire that when the platinum wire is heated by electric current applied thereto and at the same time exposed to a flow of gas, the platinum wire loses its heat to decrease in temperature so that its electric resistance decreases.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") which executes programs for calculating a correction coefficient VQKO2, referred to hereinafter, and the valve opening amount (EACV), etc., memory means storing a Ti map, referred to hereinafter, and programs executed by the CPU and for storing results of calculations therefrom, etc., and an output circuit which outputs driving signals to the fuel injection valves 6 and the purge control valve 16.

The CPU operates in response to the above-mentioned engine parameter signals from the sensors to determine operating conditions in which the engine 1 is operating, such as an air-fuel ratio feedback control region in which the fuel supply is controlled in response to the detected oxygen concentration in the exhaust gases, and open-loop control regions, and calculates, based upon the dteermined operating conditions, the valve opening period or fuel injection period TOUT over which the fuel injection valves 6 are to be opened, by the use of the following equation (1) in synchronism with inputting of TDC signal pulses to the ECU 5:

$$TOUT = Ti \times KO_2 \times VQKO_2 \times K1 + K2 \quad (1)$$

where Ti represents a basic value of the fuel injection period TOUT of the fuel injection valves 6, which is read from the Ti map in accordance with the engine rotational speed NE and the intake pipe absolute pressure PBA.

$KO_2$ represents an air-fuel ratio correction coefficient whose value is determined in response to the oxygen concentration in the exhaust gases detected by the $O_2$ sensor 12, during feedback control, while it is set to respective predetermined appropriate values while the engine is in predetermined operating regions (the open-loop control regions) other than the feedback control region.

$VQKO_2$ represents a vapor flow rate-dependent correction coefficient which is determined according to a vapor flow rate (flow rate of evaporative fuel) detected during purging of evaporative fuel. Details of the manner of determining the coefficient $VQKO_2$ will be described hereinafter with reference to FIG. 2.

K1 and K2 represent other correction coefficients and correction variables, respectively, which are calculated based on various engine parameter signals to such values as to optimize operating characteristics of the engine such as fuel consumption and accelerability depending on operating conditions of the engine.

The CPU supplies through the output circuit, the fuel injection valves 6 with driving signals corresponding to the calculated fuel injection period TOUT determined as above, over which the fuel injection valves 6 are opened.

Figure 2:
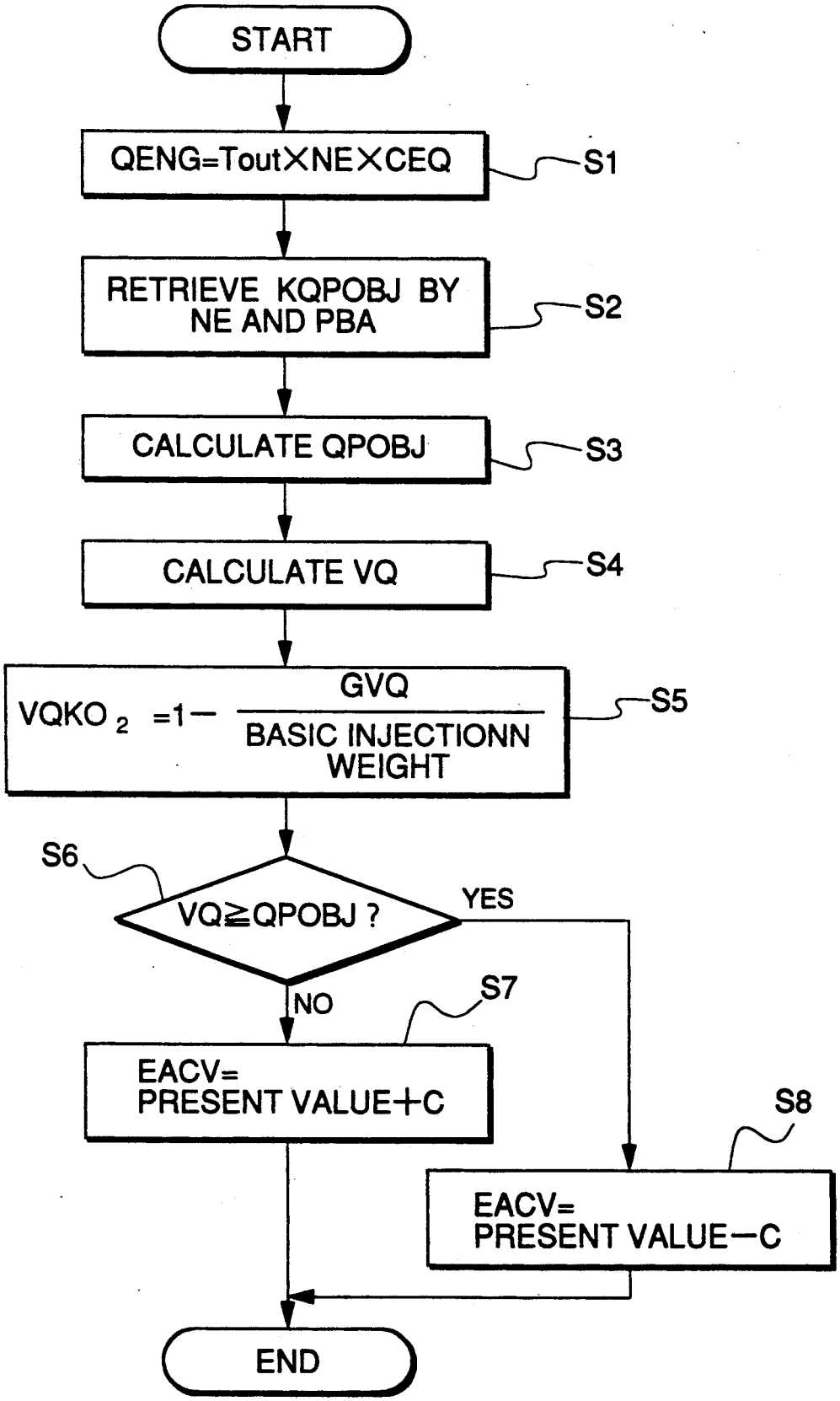
FIG. 2 is a flowchart of a program for calculating a control amount EACV and a vapor flow rate-dependent correction coefficient $VQKO_2$.

FIG. 2 shows a program for calculating the vapor flow rate-dependent correction coefficient $VQKO_2$ and a desired value of the opening of the purge control valve (control amount) EACV. This program is executed by the CPU whenever a predetermined time period elapses.

At a step S1 of FIG. 2, a flow rate QENG of air drawn into the engine 1 or intake air is calculated by the use of the following equation (2):

$$QENG = TOUT \times NE \times CEQ \quad (2)$$

where TOUT represents the fuel injection period calculated by the equation (1), and CEQ a constant for converting the product of TOUT×NE to the flow rate QENG of intake air.

At a step S2, a desired ratio KQPOBJ of the vapor flow rate to the flow rate QENG of intake air supplied to the engine is calculated from a KQPOBJ map according to the detected engine rotational speed NE and intake pipe absolute pressure PBA. The KQPOBJ map is one in which values of the desired ratio KQPOBJ are set corresponding, respectively, to combinations of a plurality of values of the engine rotational speed NE and a plurality of values of the intake pipe absolute pressure PBA.

At a step S3, a desired vapor flow rate QPOBJ is calculated by applying the flow rate QENG of intake air and the desired ratio KQPOBJ to the following equation (3):

$$QPOBJ = QENG \times KQPOBJ \quad (4)$$

The desired vapor flow rate QPOBJ may be properly corrected depending on the engine coolant temperature TW.

At a step S4, an actual value of the vapor flow rate VQ is calculated. The vapor flow rate VQ is the sum of a flow rate of evaporative fuel (vapor) generated from the fuel tank 8 and temporarily adsorbed by the canister 15, and a flow rate of evaporative fuel passing through the restriction 171 directly from the fuel tank without being adsorbed by the canister 15. Details of the manner of calculating the actual value of the vapor flow rate VQ will be described hereinafter.

At a step S5, the vapor flow rate-dependent correction coefficient $VQKO_2$ is calculated based on the actual value of the vapor flow rate VQ calculated as above. First, the vapor flow rate VQ (l/min.) is converted to a gasoline weight-equivalent flow rate GVQ (g/min.) which is a flow rate in terms of the weight of gasoline in liquid state per minute which is equivalent to the vapor flow rate VQ (l/min.) in terms of the volume of vapor per minute, by the use of the following equation (4):

$$GVQ = (VQ/VMOL) \times \text{molecular weight of gasoline vapor} \quad (4)$$

where VMOL represents a value of molar volume of one mole of molecules, which is conveniently indicated by 22.4 l/min. to be assumed at a temperature of 0° C. The molecular weight of the gasoline vapor is approx. 64. The gasoline weight-equivalent flow rate GVQ (g/min.) thus obtained is applied to the following equation (5) to calculate the vapor flow rate-dependent correction coefficient $VQKO_2$.

$$VQKO_2 = 1 - (GVQ/\text{basic injection weight}) \quad (5)$$

where the basic injection weight is a value obtained by converting the basic value Ti of the fuel injection period TOUT to the weight of fuel injected.

The vapor flow rate-dependent correction coefficient $VQKO_2$ thus obtained assumes a value of 1.0 when the purge control valve 16 is closed, and a value lower than 1.0 when the purge control valve 16 is opened to carry out purging of evaporative fuel. The fuel injection period TOUT is calculated by applying this value to the equation (1), whereby fuel is injected by the fuel injection valve 6 in amounts controlled so as to prevent fluctuations in the air-fuel ratio caused by variations in the purged amount of evaporative fuel.

Further, at a step S6, it is determined whether or not the vapor flow rate VQ obtained at the step S4 is equal to or larger than the desired vapor flow rate QPOBJ obtained at the step S3.

If the answer to the question of the step S6 is negative (No), i.e. if the calculated vapor flow rate VQ is smaller than the desired vapor flow rate QPOBJ, the control amount EACV determining the opening of the purge control valve 16 is increased from the present value by a predetermined value C at a step S7, to thereby increase the vapor flow rate, causing the evaporative emission control system to suppress emission of evaporative fuel to an increased extent, followed by terminating the present program. The predetermined value C is a constant for renewal of the value of EACV. On the other hand, if the answer to the question of the step S6 is affirmative (Yes), i.e. if the calculated vapor flow rate VQ is equal to or larger than the desired vapor flow rate QPOBJ, the control amount EACV is decreased from the present value by the predetermined value C at a step S8, to thereby reduce the vapor flow rate and hence prevent degradation in the responsiveness in the air-fuel ratio feedback control, followed by terminating the present program.

In the above described manner, the actual vapor flow rate VQ is calculated, based on which the fuel injection period TOUT is corrected (step S5) to thereby prevent fluctuations in the air-fuel ratio to be caused by purging of evaporative fuel, and at the same time the opening of the purge control valve 16 is controlled depending on the calculated vapor flow rate (steps S7, S8) to thereby prevent the average value of the air-fuel ratio correction coefficient from being largely deviated from a value of 1.0. This makes it possible to prevent degradation in the responsiveness in the air-fuel ratio feedback control which may occur when the average value, which is used as an initial value of the air fuel ratio correction coefficient $KO_2$ upon transition of the air-fuel ratio control from the open-loop mode to the feedback control mode, is largely deviated from the value of 1.0.

Next, the manner of calculation of the actual value of the vapor flow rate VQ carried out at the step S4 appearing in FIG. 2 will be described. To calculate the vapor flow rate VQ, in the present embodiment, there are calculated a flow rate (volumetric flow rate) Q1 of a mixture flowing through the purging passage 17 (i.e. the sum of the vapor flow rate VQ and an air flow rate Q2 of air introduced into the purging passage 17 via the outside air-introducing port 152 of the canister 15), and concentration of the evaporative fuel (vapor) contained in the mixture flow rate Q1.

According to the invention, the vapor flow rate VQ is calculated according to the volumetric flow rate Q1 and the concentration of evaporative fuel (vapor concentration) based on outputs from the differential pressure type flowmeter 19, 171, and the mass flowmeter 22, both appearing in FIG. 1. The two flowmeters of different types both indicate output values which vary at respective different rates relative to the actual flow rate, as the density of an object gas (in the present case, a mixture of evaporative fuel and air) i.e. vapor concentration varies. For example, even if the actual volumetric flow rate is constant, they indicate different output values (indication amounts) between when the object gas is formed of 100% air (i.e. low density) and when the the object gas is formed of 100% vapor (HC) (i.e. high density). When the gas is formed of 100% air, they output small values, whereas when the gas is formed of 100% vapor, they output large values. Further, the differential pressure type flowmeter shows a different output characteristic curve relative to change in the density of the object gas, i.e. vapor concentration, from that of the mass flowmeter. For example, when the mixture is formed of 100% air, both the flowmeters indicate a value of 1.0, whereas when the mixture is formed of 100% vapor, the differential pressure type flowmeter indicates a value of 1.69, while the mass flowmeter a value of 4.45.

The present invention utilizes the fact that different types of flowmeters have different output characteristics relative to the vapor concentration in the evaporative mixture (the mixture of evaporative fuel and air). According to the invention, the volumetric flow rate Q1 of the evaporative mixture, the vapor concentration $\beta$, and then the vapor flow rate VQ are determined based on outputs from two types of flowmeters having different output characteristics (in the present embodiment, the differential pressure type flowmeter and the mass flowmeter).

Next, the manner of calculating the vapor flow rate VQ according to the present embodiment will be described in detail.

Figure 3:
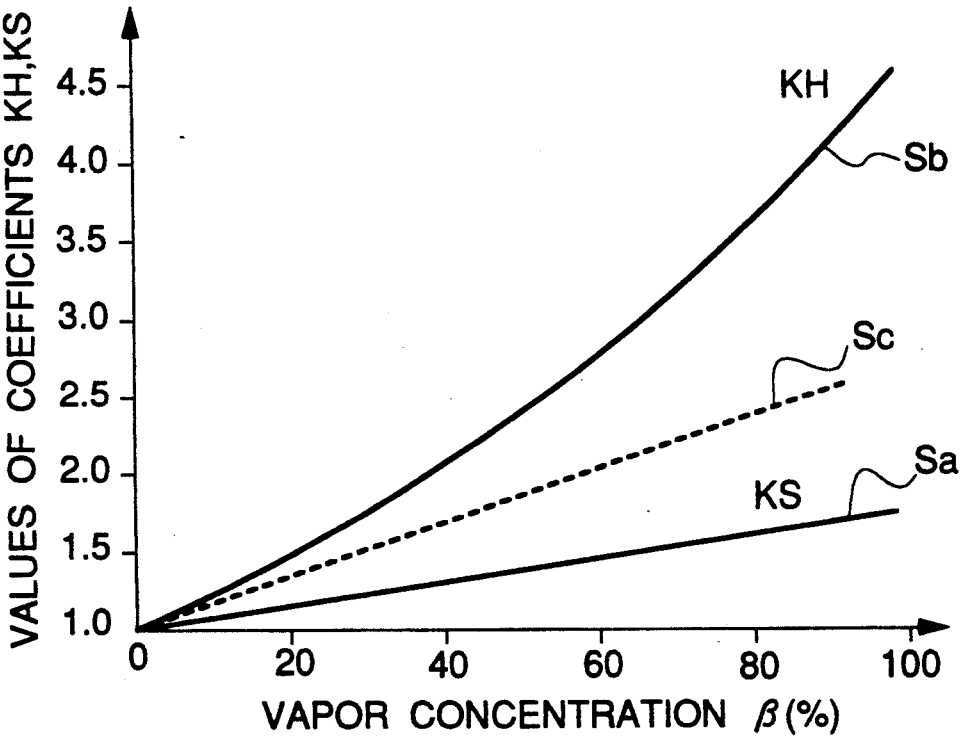
FIG. 3 is a graph showing the relationship between the flowmeter coefficient and the vapor concentration.

The mixture flow rate Q1 measured based on the outputs from the two flowmeters can be expressed by the following equations (6) and (7):

$$Q1 = QH \times (1/KH) \quad (6)$$

$$Q1 = QS \times (1/KS) \quad (7)$$

where QH represents an output value indicated by the hot wire type flowmeter 22 (indicated amount of the volumetric flow rate), QS an output value indicated by the differential pressure type flowmeter (indicated amount of the volumetric flow rate), and KH and KS represent coefficients determined according to the vapor concentration (concentration in terms of volumetric ratio), by which are multiplied the output values QH and QS indicated by the flowmeters, respectively. The coefficients KH and KS are experimentally determined, such that for example, when the vapor concentration $\beta=0$, KH=KS=1. FIG. 3 shows the relationship between the coefficients KH, KS and the vapor concentration $\beta$. In the figure, the solid lines Sa and Sb indicate values of the coefficients KH and KS, while the broken line Sc indicates values of the ratio $\alpha$=KH/KS. From the equations (6) and (7), the following equation (8) results:

$$\alpha = KH/KS = QH/QS \quad (8)$$

That is, from the output values QH and QS indicated by the hot wire type flowmeters 22 and the differential flowmeter, the ratio $\alpha$ is obtained, and hence the vapor concentration $\beta$ is also obtained from FIG. 3. Further, FIG. 3 gives values of the coefficients KH, KS according to the vapor concentration $\beta$, so that the mixture flow rate Q1 is obtained from the equation (6) or (7). The vapor flow rate VQ (l/min.) is obtained by applying the obtained values of the mixture flow rate Q1 and the vapor concentration $\beta$ to the following equation (9):

$$VQ = Q1 \times \beta (\beta \leqq 1) \quad (9)$$

By applying the value of the vapor flow rate VQ thus obtained to the equation (4), the gasoline weight-equivalent flow rate GVQ is obtained, and accordingly from the equation (5), the vapor flow rate-dependent correction coefficient $VQKO_2$ is obtained.

Thus, by utilizing the fact that the ratio $\alpha$= QH/QS varies with the vapor concentration $\beta$, the vapor flow rate VQ can be calculated.

Figure 4:
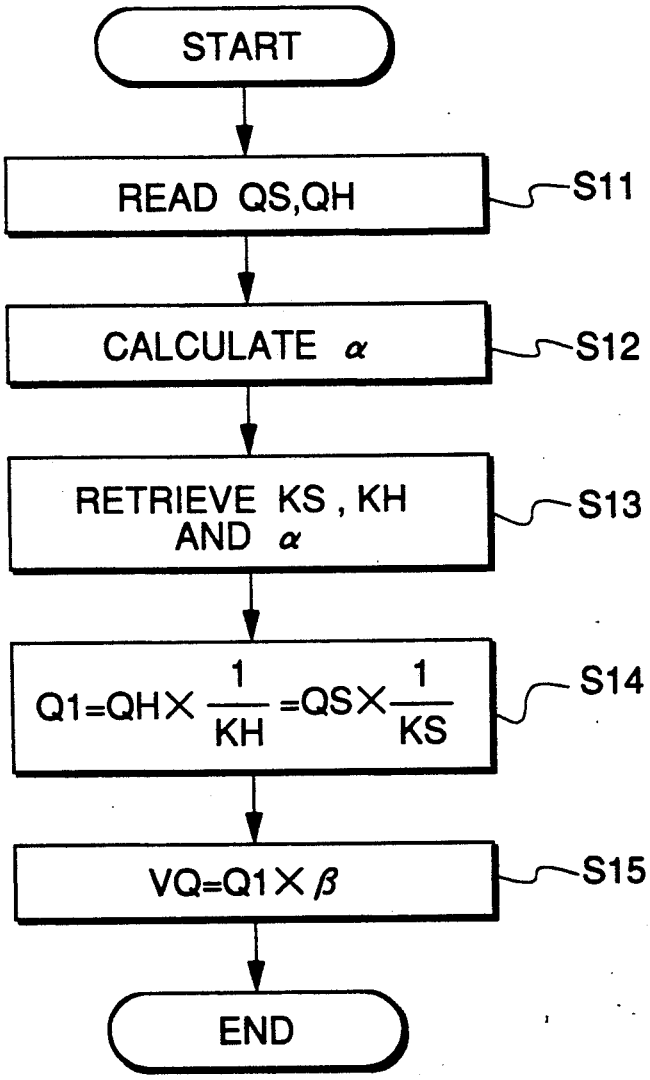
FIG. 4 is a flowchart of a program for calculating a vapor flow rate.

FIG. 4 shows a program for calculating the vapor flow rate VQ. First, at a step S11, the output values QS, QH indicated by the flowmeters are read, and stored into the memory means within the ECU 5. Then, the ECU operates to calculate the ratio $\alpha$ by applying the output values QS and QH to the equation (8) at a step S12. Then, at a step S13, the coefficients KS, KH and the vapor concentration $\beta$ are retrieved according to the ratio $\alpha$. In this connection, retrieval of only one of the coefficients KS and KH suffices for calculating the vapor flow rate VQ.

Figure 5:
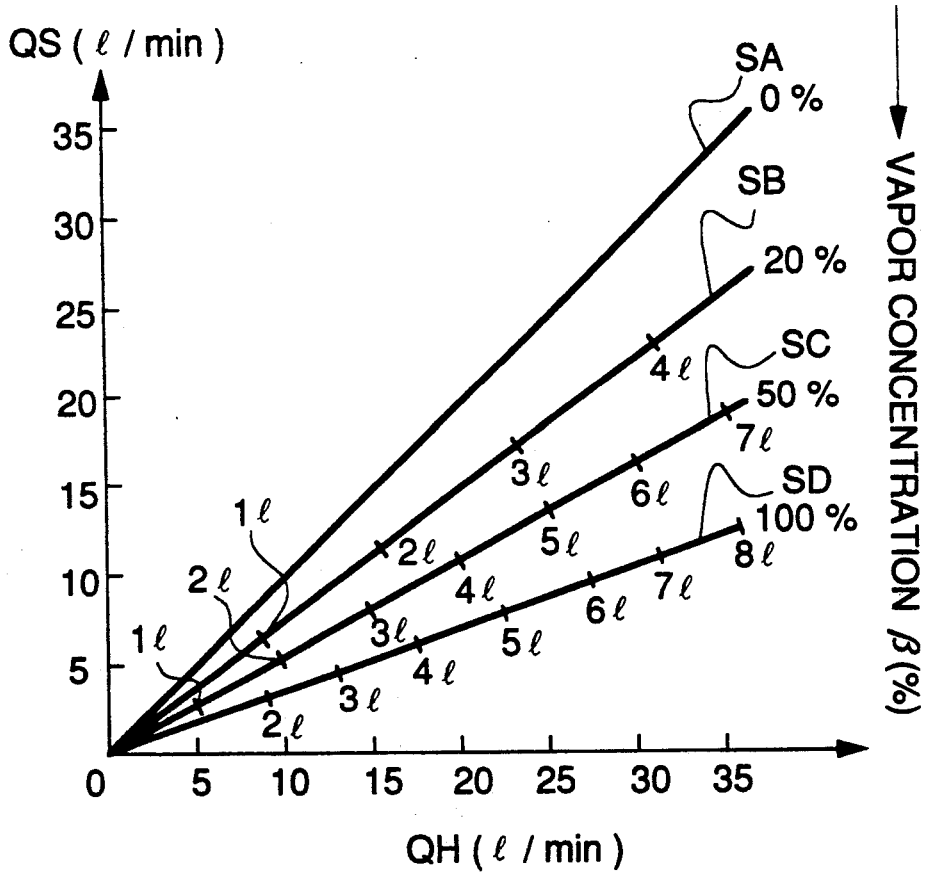
FIG. 5 is a graph for calculating the vapor flow rate from values indicated by a differential pressure type flowmeter and a hot wire type flowmeter, respectively.

Then, the ECU 5 calculates the mixture flow rate Q1 either from the indicated value QH and the coefficient KH or from the indicated value QS and the coefficient KS at a step S14, and calculate the vapor flow rate VQ from the mixture flow rate Q1 and the vapor concentration $\beta$ at a step S15. In short, the vapor flow rate VQ can be obtained from the output values QS, QH indicated by the flowmeters. This is exemplified in FIG. 5. Therefore, by storing values of the vapor flow rate VQ corresponding to values of the indicated values QS, QH as a map in the memory means of the ECU 5, the vapor flow rate VQ need not be calculated each time, allowing rapid processing of data.

Figure 6:
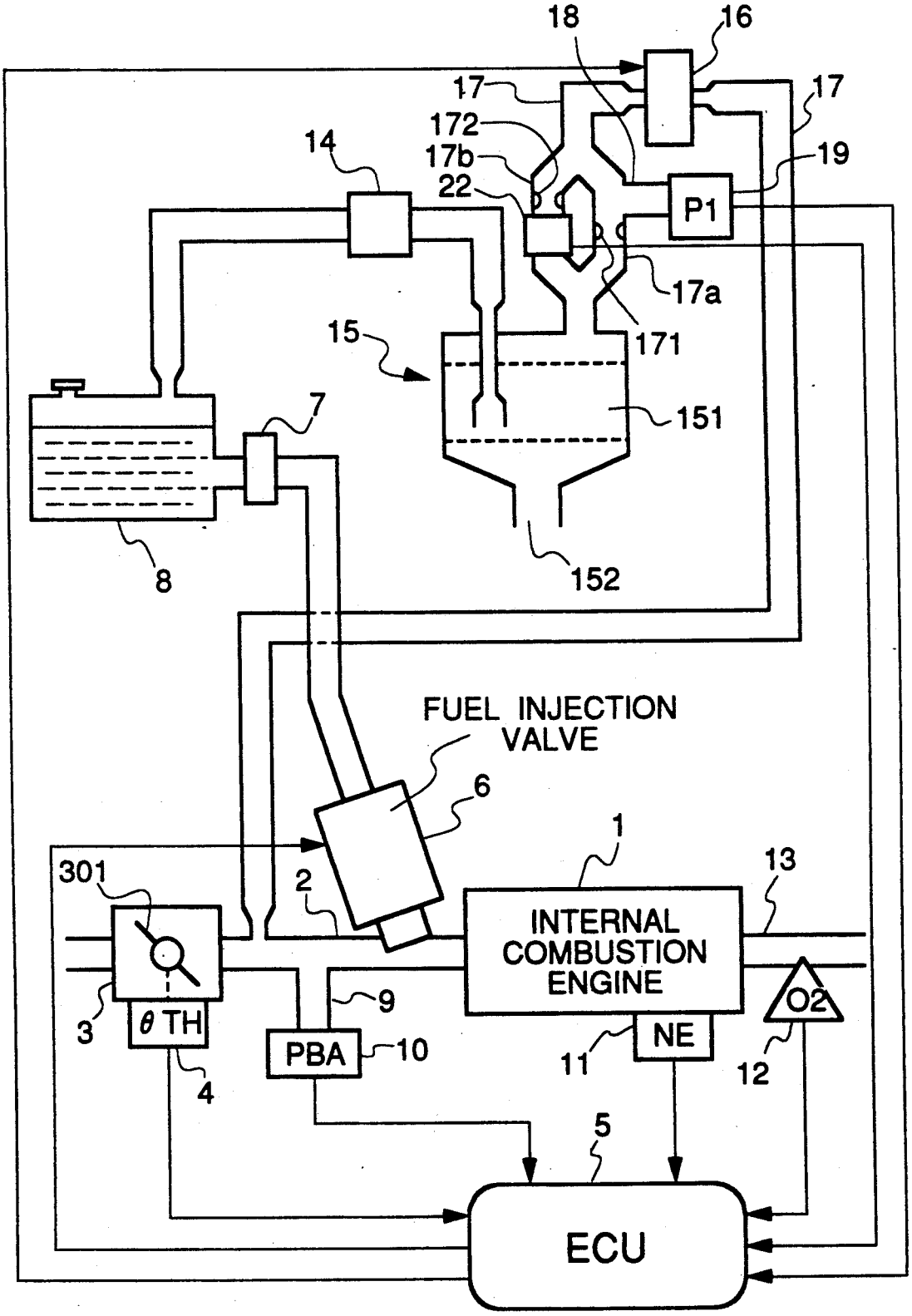
FIG. 6 is a block diagram showing the whole arrangement of a fuel supply control system according to another embodiment of the invention.

Although, in the embodiment shown in FIG. 1, the differential pressure type flowmeter 19, 171 is connected in series with the hot wire type flowmeter 22, this is not limitative, but they may be connected in parallel with each other, as shown in FIG. 6, which schematically illustrates another embodiment of the invention. In FIG. 6, a portion of the purging passage 17 is formed by a pair of conduits 17*a*, 17*b* connected in parallel with each other. The conduits 17*a*, 17*b* are formed with respective restrictions 171, 172. One conduit 17*a* is connected to a pressure gauge $P_1$, while the other conduit 17*b* has a hot wire type flowmeter 22 arranged across the conduit 17*b*. Assuming that the flow rate of the evaporative mixture flowing through the conduit 17*a* is represented by Q11, and the flow rate of same flowing through the conduit 17*b* by Q12, the following equations (10), (11), and (12) hold:

$$Q1=Q11+Q12 \quad (10)$$

$$Q11=QS/KS \quad (11)$$

$$Q12=QH/KH \quad (12)$$

where the symbols QS, KS, QH, and KH represent the same values as applied in the previous embodiment, and therefore description thereof is omitted. Let it be assumed that the actual flow rate Q11 of the mixture flowing through the conduit 17*a* is equal to the actual flow rate Q12 of the mixture flowing through the conduit 17*b*, and the two mixtures have the same vapor concentration, QS/KS=QH/KH results from the equations (11) and (12). Therefore, like the equation (8), the ratio $\alpha$=KH/KS=QH/QS holds. Accordingly, the coefficients KS and KH of the equations (11) and (12), and the vapor concentration $\beta$ are obtained from FIG. 3. Further, the flow rates Q12, Q11, Q1, and finally the vapor flow rate VQ can be obtained.

Although, in the above described embodiments, the vapor concentration $\beta$ and the mixture flow rate Q1 are first obtained, and therefrom the vapor flow rate VQ is obtained, this is not limitative, but the vapor flow rate VQ may be first obtained from a map according to the indicated values QS and QH, while the mixture flow rate Q1 from another map according to same, and thereafter the vapor concentration is obtained by VQ/Q1=$\beta$.

Further, in the above described embodiments, a combination of a differential pressure type flowmeter and a hot wire type flowmeter is employed. However, this is not limitative, but what is required is to use two flowmeters having different output characteristics relative to the vapor concentration, and therefore, other combinations of flowmeters, such as a combination of a deflection ultrasonic flowmeter and a vortex flowmeter, may also be employed.

What is claimed is:

1. In a device for measuring a flow rate of a mixture of evaporative fuel and air supplied to an internal combustion engine, said engine having an intake passage, a fuel tank, a canister for absorbing evaporative fuel generated from said fuel tank, and a purging passage connecting between said canister and said intake passage for purging said mixture of evaporative fuel and air therethrough into said intake passage, the improvement comprising:

a plurality of flowmeters arranged in said purging passage, said flowmeters having different output characteristics relative to concentration of said evaporative fuel in said mixture; and detecting means for detecting at least one of the concentration of said evaporative fuel in said mixture and a volumetric flow rate of said mixture, based on outputs from said flowmeters.

2. A device according to claim 1, wherein said detecting means detects at least one of the concentration of said evaporative fuel in said mixture and said volumetric flow rate of said mixture, by the use of a ratio between said outputs from said flowmeters.

3. A device according to claim 1, wherein said flowmeters are arranged in said purging passage in series with each other.

4. A device according to claim 1, wherein said flowmeters are arranged in said purging passage in parallel with each other.

5. A device according to claim 4, wherein said purging passage has a portion formed of a plurality of conduits extending parallel with each other, said flowmeters being arranged, respectively, in said conduits.

6. A device according to claim 1 or 2, wherein said flowmeters comprise a differential pressure type flowmeter and a mass flowmeter.

7. In an air-fuel ratio control system for an internal combustion engine having an intake passage, a fuel tank, a canister for adsorbing evaporative fuel generated from said fuel tank, and a purging passage connecting between said canister and said intake passage for purging a mixture of evaporative fuel and air therethrough into said intake passage, the improvement comprising:

a plurality of flowmeters arranged in said purging passage, said flowmeters having different output characteristics relative to concentration of said evaporative fuel in said mixture;

detecting means for detecting the concentration of said evaporative fuel in said mixture and a volumetric flow rate of said mixture, based on outputs from said flowmeters;

evaporative fuel weight-calculating means for calculating weight per unit time of evaporative fuel supplied to said intake passage from the detected concentration of said evaporative fuel and the detected volumetric flow rate of said mixture; and correcting means for correcting the air-fuel ratio of a total air-fuel mixture supplied to said engine by the use of a ratio of the calculated weight per unit time of evaporative fuel supplied by purging to said intake passage to weight per unit time of fuel supplied by injection to said engine.

8. An air-fuel ratio control system according to claim 7, wherein said correcting means corrects the air-fuel ratio of said total mixture supplied to said engine by correcting a basic fuel injection amount determined depending on a plurality of engine operating parameters in a manner such that the amount of fuel injected into said engine becomes smaller, as said ratio is larger.

9. An air-fuel ratio control system according to claim 8, wherein said correcting means corrects the air-fuel ratio of said total mixture supplied to said engine by multiplying said basic fuel injection amount by a correction coefficient determined by said ratio.

10. An air-fuel ratio control system according to claim 8, further including:

control valve means arranged across said purging passage for controlling the flow rate of said mixture of evaporative fuel and air supplied to said intake passage;

desired evaporative fuel flow rate-calculating means for calculating a desired flow rate of purged evaporative fuel from a flow rate of intake air supplied to said engine;

actual evaporative fuel flow rate-calculating means for calculating an actual flow rate of purged evaporative fuel from the detected concentration of said evaporative fuel and the detected volumetric flow rate of said mixture; and control valve-controlling means for comparing between said desired flow rate of said purged evaporative fuel and said actual flow rate of same, and correcting based on results of the comparison, the opening of said control valve.

* * * * *